US009422801B2

(12) United States Patent
Skinner

(10) Patent No.: US 9,422,801 B2
(45) Date of Patent: Aug. 23, 2016

(54) MODULATED OPTO-ACOUSTIC CONVERTER

(71) Applicant: Halliburton Energy Services, Inc., Houston, TX (US)

(72) Inventor: Neal Gregory Skinner, Lewisville, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 389 days.

(21) Appl. No.: 13/946,341

(22) Filed: Jul. 19, 2013

(65) Prior Publication Data

US 2015/0021009 A1 Jan. 22, 2015

(51) Int. Cl.

| | |
|---|---|
| ***E21B 47/12*** | (2012.01) |
| ***E21B 47/00*** | (2012.01) |
| ***E21B 47/10*** | (2012.01) |

(52) U.S. Cl.

CPC ..... *E21B 47/00* (2013.01); *E21B 47/101* (2013.01); *E21B 47/123* (2013.01)

(58) Field of Classification Search

CPC ..... E21B 47/123; E21B 47/122; E21B 47/14; E21B 47/12; E21B 47/16; E21B 47/101

USPC ..... 340/854.3, 854.7, 856.4; 367/81

See application file for complete search history.

(56) References Cited

U.S. PATENT DOCUMENTS

| | | | | |
|---|---|---|---|---|
| 4,375,073 | A * | 2/1983 | Glogolja | H03K 17/795 361/101 |
| 5,675,429 | A * | 10/1997 | Henmi | G02B 6/29377 385/123 |
| 5,675,674 | A | 10/1997 | Weis | |
| 2007/0062696 | A1 | 3/2007 | Wilson et al. | |
| 2008/0062036 | A1 | 3/2008 | Funk et al. | |
| 2009/0213690 | A1 * | 8/2009 | Steinsiek | G01V 1/40 367/35 |
| 2010/0025032 | A1 * | 2/2010 | Smith | E21B 23/00 166/244.1 |
| 2013/0087328 | A1 | 4/2013 | Maida, Jr. et al. | |
| 2014/0204712 | A1 * | 7/2014 | Skinner | E21B 47/14 367/81 |

OTHER PUBLICATIONS

International Patent Application No. PCT/US2014/046093, International Search Report and Written Opinion mailed Oct. 23, 2014, 15 pages.

Australian Application No. 2014290595, First Examiner Report mailed on Mar. 10, 2016, 3 pages.

* cited by examiner

*Primary Examiner* — David Andrews
*Assistant Examiner* — Kristyn Hall
(74) *Attorney, Agent, or Firm* — Kilpatrick Townsend & Stockton LLP

(57) ABSTRACT

An opto-acoustic subsystem is provided. The subsystem includes an optical transmitter and an actuator device. The optical transmitter can be positioned at a surface of a wellbore. The actuator device can be positioned in the wellbore and can respond to a modulated electrical signal generated from a modulated optical signal received from the optical transmitter by outputting a modulated acoustical signal into an environment of the wellbore.

20 Claims, 5 Drawing Sheets

MODULATED OPTO-ACOUSTIC CONVERTER

TECHNICAL FIELD

The present disclosure relates generally to optically powered and controlled systems for use in a wellbore and, more particularly (although not necessarily exclusively), to downhole actuator devices for producing acoustic signals and being controlled by optical signals from surface devices.

BACKGROUND

Hydrocarbons can be produced from wellbores drilled from the surface through a variety of subsurface formations. A wellbore may be substantially vertical or may be deviated. Conditions and other parameters in the wellbore can be sensed using powered devices downhole. For example, many parameters, such as pressure, temperature, fluid density, and fluid flow rate, may be sensed downhole and their values reported to the surface. Powering these devices electrically can be challenging in view of, among other things, temperature limitations of complex electronic sensors.

DETAILED DESCRIPTION

Certain aspects and features relate to a controlled or modulated acoustic source that is downhole and that is optically powered by optical signals from the surface of a wellbore. Acoustical energy from the acoustic source can be detected and analyzed for determining downhole parameters or conditions. For example, the acoustic source may be in fluid or attached to a pipe or other tubular. Parameters of the fluid or pipe movement can be determined using a modulated acoustical signal from the acoustic source.

In some aspects, an acoustic source is a downhole actuator that can respond to a modulated optical signal received by optical fiber from an optical transmitter at the surface of the wellbore by outputting a modulated acoustical signal. For example, the downhole actuator can include a photodiode and a piezoelectric actuator. The photodiode can detect the modulated optical signal and transform it into a modulated electrical signal. The piezoelectric actuator can respond to the modulated electrical signal by outputting a modulated acoustical signal that can travel through the environment in the wellbore and be detected by a sensor in the wellbore. The sensed signal can be analyzed to determine downhole conditions or parameters.

An acoustic source according to some aspects can provide a modulated acoustical signal without requiring externally applied electric power or copper or other electrical conductors to be run from an electrical power source to the acoustic source. In some aspects, the acoustic source can be used as a component for optical downhole flow measurement, data transmission, and monitoring of the state of cure of cement, for example.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
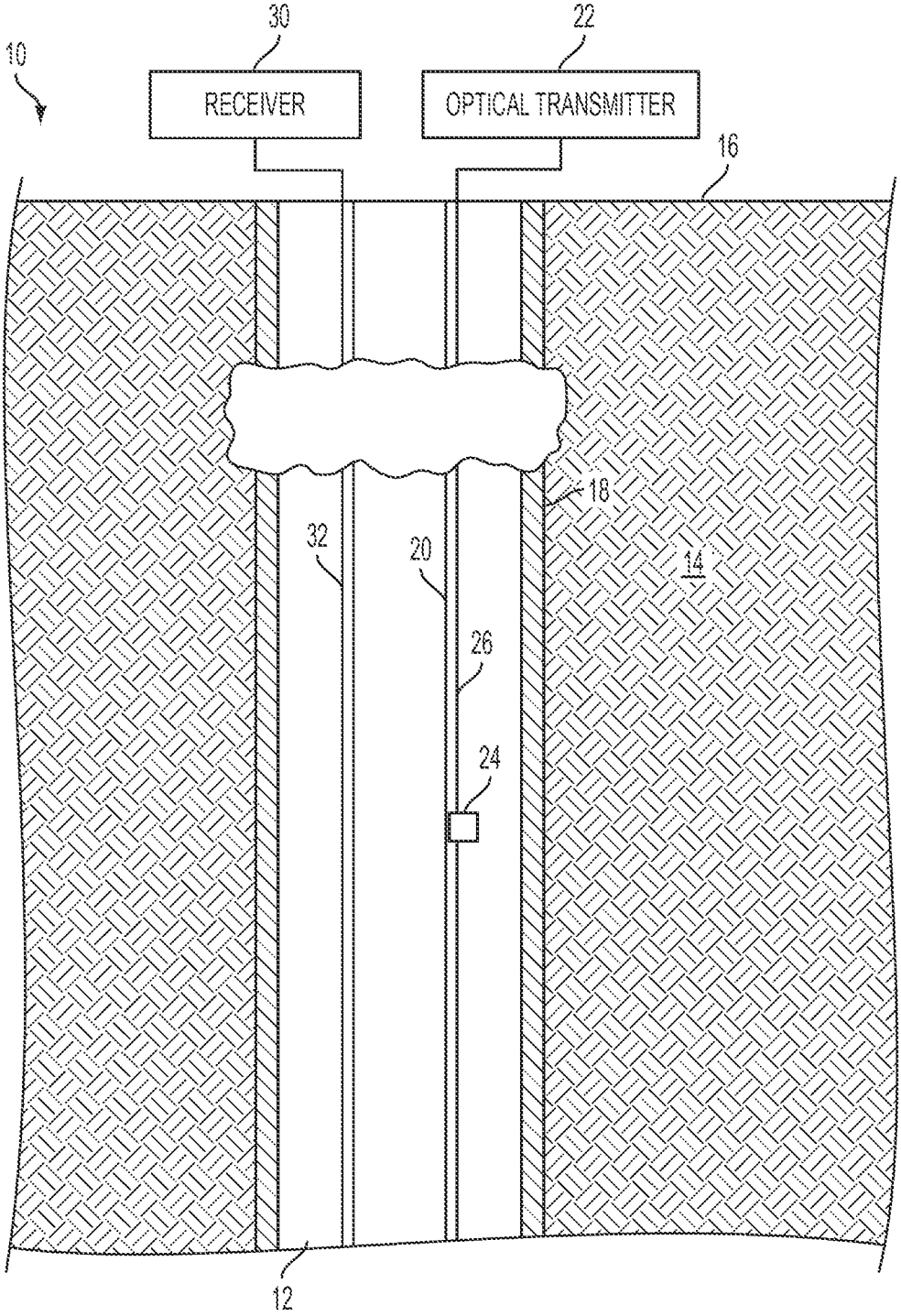
FIG. 1 is a cross-sectional schematic view of a wellbore that includes an opto-acoustic subsystem according to one aspect.

FIG. 1 depicts an example of a wellbore system 10 that includes an acoustic source according to one aspect. The system 10 includes a wellbore 12 that penetrates a subterranean formation 14 for the purpose of recovering hydrocarbons, storing hydrocarbons, disposing of carbon dioxide, or pumping fluid into the well for stimulation (e.g., fracturing, acidizing, etc.) of producing zones or for storage or disposal. The wellbore 12 may be drilled into the subterranean formation 14 using any suitable drilling technique. While shown as extending vertically from the surface 16 in FIG. 1, in other examples the wellbore 12 may be deviated, horizontal, or curved over at least some portions of the wellbore 12. The wellbore 12 may be cased, open hole, contain tubing, and may include a hole in the ground having a variety of shapes or geometries.

The wellbore system 10 includes a casing 18 extending through the wellbore 12 in the subterranean formation 14. A tubular 20 extends from the surface 16 in an inner area defined by the casing 18. The tubular 20 may be production tubing through which hydrocarbons or other fluid can enter and be produced. In other aspects, the tubular 20 is another type of tubing.

Some items that may be included in the wellbore system 10 have been omitted for simplification. For example, the wellbore system 10 may include a servicing rig, such as a drilling rig, a completion rig, a workover rig or other mast structure, or a combination of these. In some aspects, the servicing rig may include a derrick with a rig floor. Piers extending downwards to a seabed in some offshore implementations may support the servicing rig. Alternatively, the servicing rig may be supported by columns sitting on hulls or pontoons (or both) that are ballasted below the water surface, which may be referred to as a semi-submersible platform, rig, or drillship. In an off-shore location, a casing or riser may extend from the servicing rig to the sea floor to exclude sea water and contain drilling fluid returns. Other mechanical mechanisms that are not shown may control the run-in and withdrawal of a workstring in the wellbore 12. Examples of these other mechanical mechanisms include a draw works coupled to a hoisting apparatus, a slickline unit or a wireline unit including a winching apparatus, another servicing vehicle, and a coiled tubing unit.

The wellbore system 10 includes an opto-acoustic subsystem that can output a modulated acoustical signal in the wellbore 12. The opto-acoustic subsystem includes an optical transmitter 22 at the surface, an actuator device 24 in the wellbore 12, and a cable 26 between the optical transmitter 22 and the actuator device 24. The cable 26 can include one or more optical fibers. In other aspects, the cable 26 is one or more optical fibers. The cable 26 may also include other types of conductors, such as electrical conductors. The cable 26 is located exterior to the tubular 20. The optical fibers may be single mode or multi-mode fiber, or multiple optical fibers can be run in parallel to supply higher optical power than may be supplied by a single optical fiber. The optical transmitter 22 can transmit a modulated optical signal through the optical fibers in the cable 26 to the actuator device 24. The actuator device 24 can transform the modulated optical signal into a modulated electrical signal, and then output a modulated acoustical signal into an environment of the wellbore 12 using the modulated electrical signal.

The opto-acoustic subsystem can also include a receiver 30 and a line 32. The line 32 may be exterior to the tubular 20. The line 32 can include one or more sensors (not shown) that can detect the modulated acoustical signal after the modulated acoustical signal has traveled through the environment of the wellbore 12. The detected acoustical signal can be provided to the receiver 30 by the line 32. The receiver 30 can analyze the detected acoustical signal and determine a parameter or characteristics of the environment of the wellbore 12. For example, the receiver 30 may detect a fluid flow rate or the density of a fluid flowing in the wellbore 12, and the information may be used to control production in a zone of the wellbore 12. The line 32 may be any type of suitable signal conveyance. Examples of the line 32 include an optical fiber, an electrical cable, or both. The line 32 itself may detect modulated acoustical signals or it can be coupled to devices in the wellbore 12 that can detect modulated acoustical signals. The devices may convert the detected modulated acoustical signals to electrical signals, optical signals, or both, prior to transmitting signals to the receiver 30. The line 32 may contain an optical fiber, which may be itself the detector by being connected to a suitable receiver. For example, the line 32 may be connected to a receiver 30 which is a distributed acoustic sensor (DAS) unit.

In other aspects, the opto-acoustic subsystem does not include the separate line 32. The cable 26 can be used to convey signals from the wellbore 12 to components at the surface 16. Furthermore, the optical transmitter 22 and the receiver 30 can be connected to the same cable, such as to the same or different optical fibers or conductors in the cable.

Figure 2:
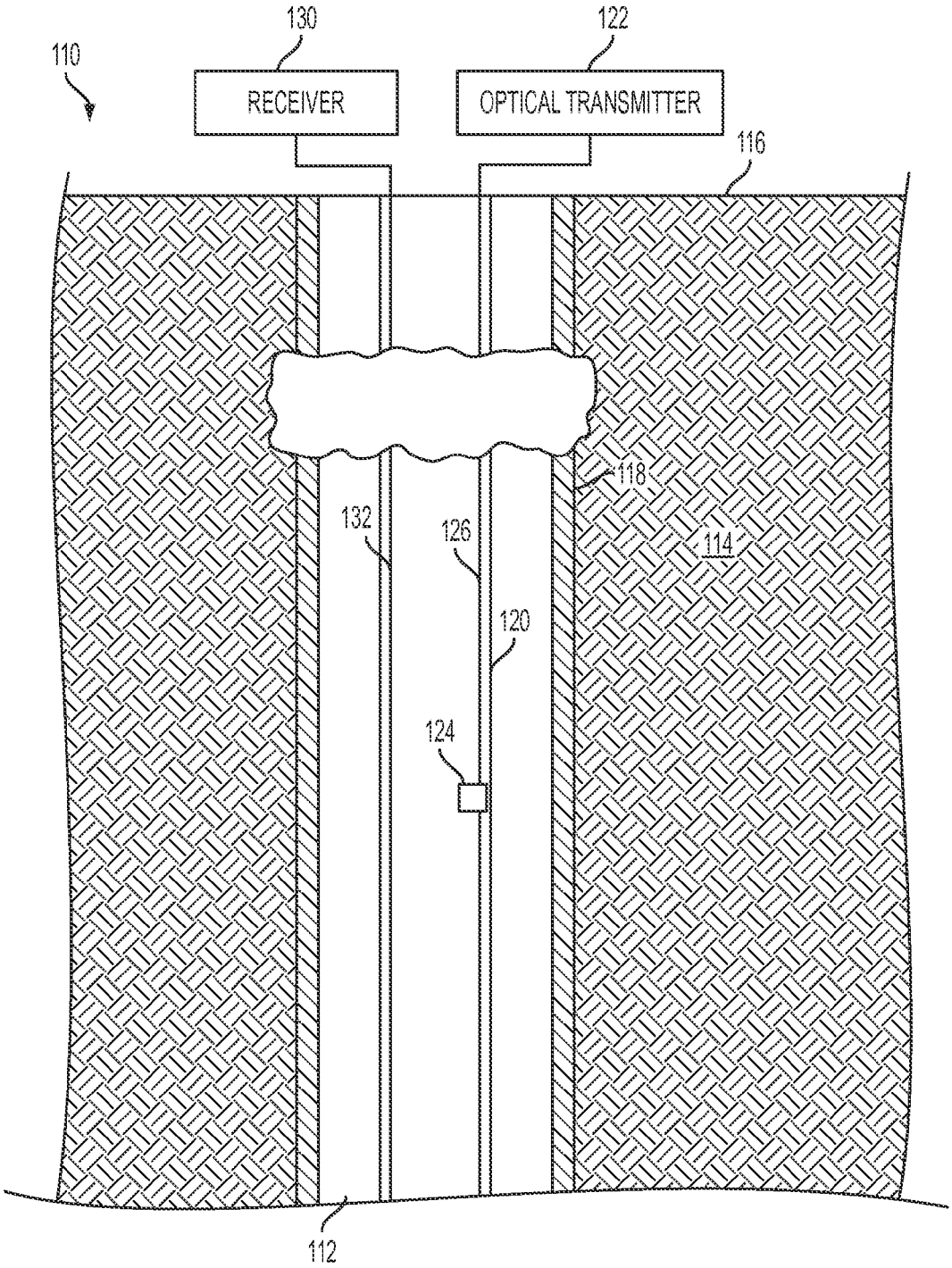
FIG. 2 is a cross-sectional schematic view of a wellbore that includes an opto-acoustic subsystem according to another aspect.

Optical fibers and actuator devices according to other aspects can be positioned in wellbore locations other than the exterior of tubing. FIG. 2 depicts a wellbore system 100 according to another aspect. The wellbore system 100 is similar to the wellbore system 10 in FIG. 1. It includes a wellbore 112 through a subterranean formation 114. Extending from the surface 116 of the wellbore 112 is a casing 118 and tubular 120 in an inner area defined by the casing 118. The opto-acoustic subsystem includes an optical transmitter 122 at the surface 116 and an actuator device 124 in the wellbore 112. The actuator device 124 is communicatively coupled to the optical transmitter 122 by a cable 126. The cable 126 can include one or more optical fibers.

The cable 126 and the actuator device 124 are in an inner area defined by the tubular 120. In other aspects, the cable 126 may be hung inside the tubular 120 or spooled win and out with a winch. The opto-acoustic subsystem also includes a receiver 130 at the surface 116 and a line 132 in an inner area defined by the tubular 120. The actuator device 124 in the inner area defined by the tubular 120 can output modulated acoustical signals according to modulated electrical signals created in the actuator device 124 from modulated optical signals received from the optical transmitter via the cable 126. The line 132 may include one or more sensors that can detect the modulated acoustical signals after the modulated acoustical signals have traveled through part of a wellbore environment. The detected signals can be conveyed to the receiver 130 for analysis.

Actuator devices according to various aspects may be located in any position in a wellbore. For example, an actuator device may be integrated in tubing. In some aspects, a wellbore includes multiple actuator devices located in multiple production zones separated by packers or other wellbore components.

Figure 3:
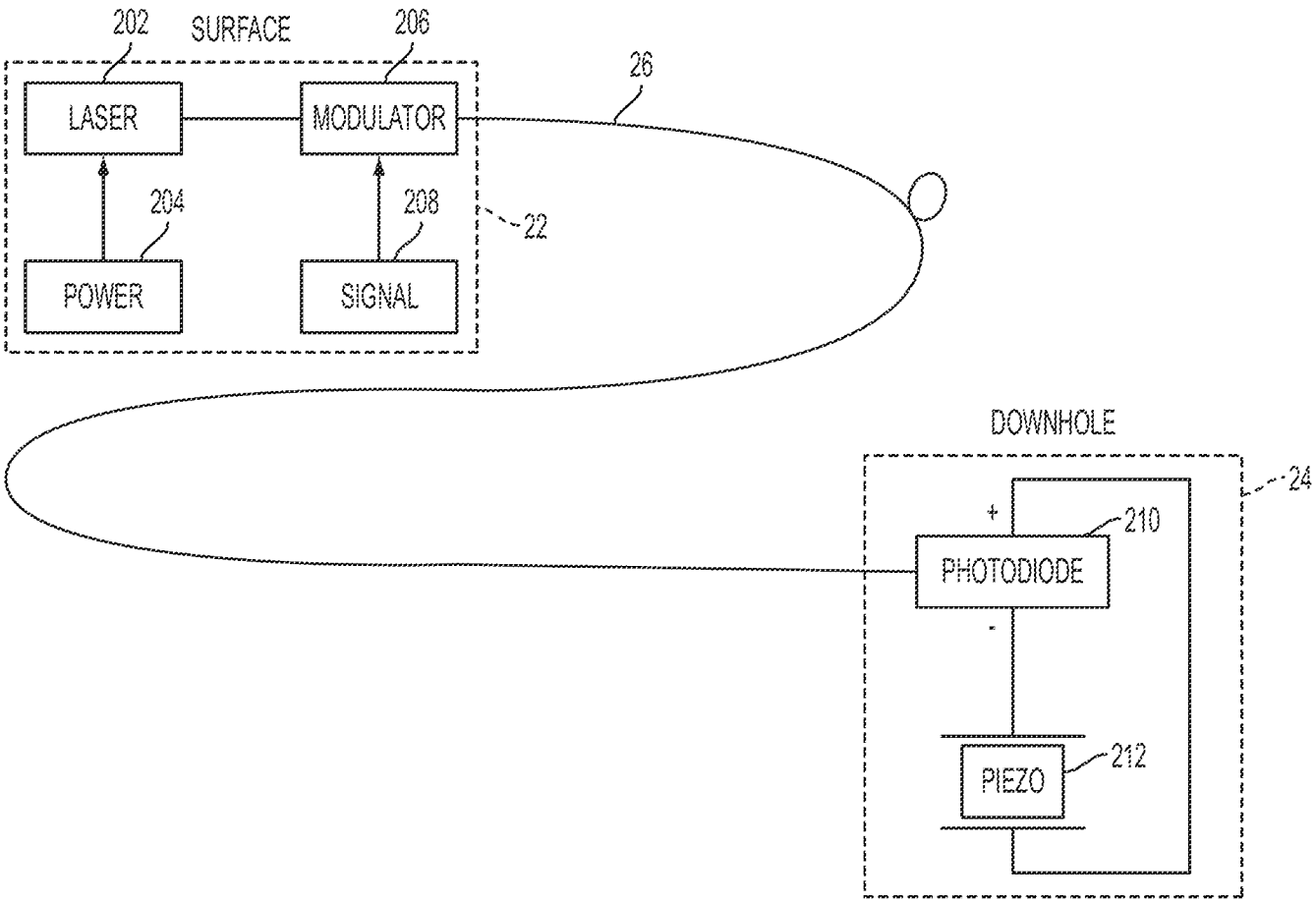
FIG. 3 is a schematic view of an opto-acoustic subsystem according to one aspect.

FIG. 3 is a schematic diagram of the optical transmitter 22 and the actuator device 24 of FIG. 1 according to one aspect. The optical transmitter 22 is at a surface of the wellbore. The actuator device 24 is a downhole device in the wellbore.

The optical transmitter 22 includes a laser 202, a power source 204, a modulator 206, and a signal source 208. The power source 204 can provide electrical power to the laser 202. Light from the laser 202 can be modulated by the modulator 206 according to a modulation signal from the signal source 208. For example, the signal source 208 can provide a continuous wave signal and the modulator 206 can vary the output of the optical transmitter 22 according to the continuous wave signal. In other aspects, the power from the power source 204 is modulated. Any type of optical modulation technique can be used. The output of the optical transmitter 22 can be a modulated optical signal that is coupled to the cable 26. The laser output may be modulated by varying the electrical power supplied to the laser 202. Modulation may include turning power to the laser 202 on and off with a predetermined frequency or in a particular pattern such that modulator 206 may be omitted. The actuator device 24 includes a photodiode 210 and a piezoelectric actuator 212. The photodiode 210 can receive the modulated optical signal from the cable 26, which may be or include an optical fiber, and generate a modulated electrical signal from the modulated optical signal. The modulated electrical signal can cause the piezoelectric actuator 212 to generate a modulated acoustical signal in response to the modulated electrical signal that has been generated in response to the modulated optical signal received from the optical transmitter 22. For example, the piezoelectric actuator 212 can expand and contract based on a frequency of the modulated electrical signal to create a sound that is a modulated acoustical signal. The frequency of the modulated acoustical signal can correspond to the frequency of the modulated optical signal from the optical transmitter 22. In some aspects, the photodiode 210 is a stack of photodiodes and the piezoelectric actuator 212 is a stack of piezoelectric actuators, in one component. Examples of the component include a 6 volt or 12 volt photovoltaic power converter (i.e., PPC-6 or PPC-12) from JDS Uniphase Corporation.

Figure 4:
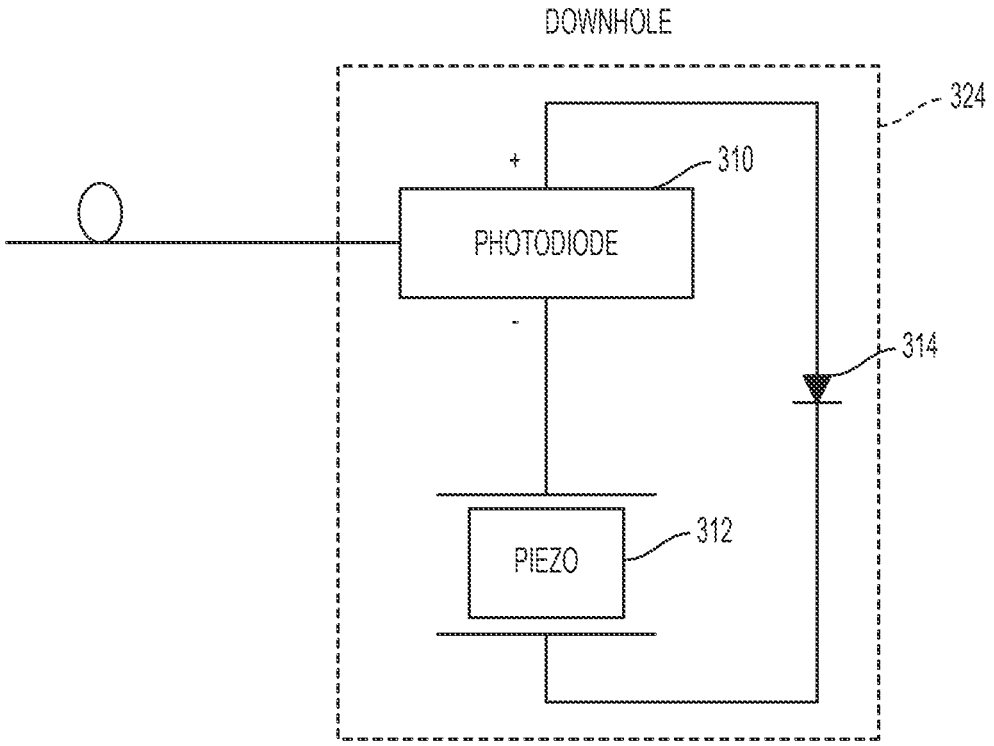
FIG. 4 is a schematic view of an actuator device of an opto-acoustic subsystem according to one aspect.

An actuator device according to some aspects may include additional components. FIG. 4 schematically depicts an actuator device 324 according to another aspect. The actuator device 324, which can be positioned downhole in a wellbore, includes a photodiode 310, a piezoelectric actuator 312, and a blocking diode 314. Photodiodes can be damaged by reverse bias and piezoelectric actuators can generate a voltage when deformed. The blocking diode 314 can prevent voltages, such as voltage spikes, that may be generated by the piezoelectric actuator 312 from damaging the photodiode 310.

Figure 5:
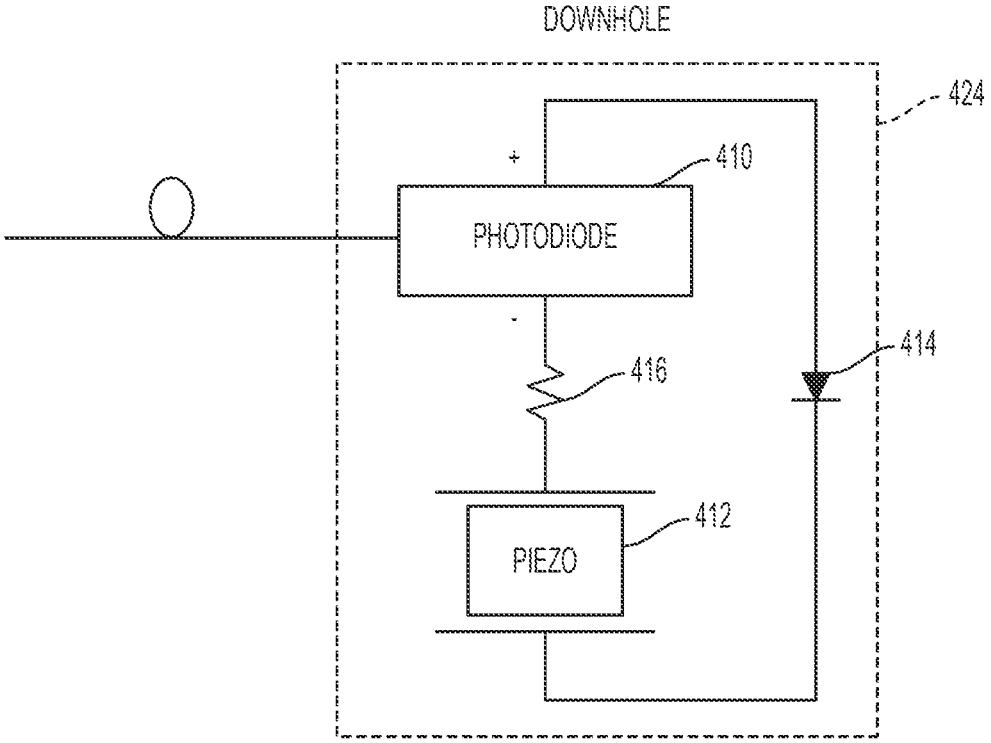
FIG. 5 is a schematic view of an actuator device of an opto-acoustic subsystem according to another aspect.

FIG. 5 schematically depicts an actuator device 424 according to another aspect. The actuator device 424, which can be positioned downhole in a wellbore, includes a photodiode 410, a piezoelectric actuator 412, a blocking diode 414, and a resistor 416. The resistor 416 is in series with the piezoelectric actuator 412. The resistor 416 can limit the amount of current that is provided to the piezoelectric actuator. In some aspects, an actuator device can include the current-limiting resistor 416 without including the blocking diode 414.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A downhole device, comprising:

a photodiode; and an actuator that is responsive to a modulated electrical signal generated by the photodiode from a modulated optical signal received from an optical transmitter at a surface of a wellbore by outputting a modulated acoustical signal into an environment of the wellbore.

2. The downhole device of claim 1, wherein the downhole device is communicatively coupled to the optical transmitter by an optical fiber.

3. The downhole device of claim 1, wherein the actuator is a piezoelectric actuator.

4. The downhole device of claim 1, further comprising a blocking diode between the photodiode and the actuator.

5. The downhole device of claim 1, further comprising a current limiting resistor between the photodiode and the actuator.

6. The downhole device of claim 1, wherein the downhole device is not supplied with electric power.

7. The downhole device of claim 1, wherein the downhole device is located external to a tubular in the wellbore.

8. The downhole device of claim 1, wherein the downhole device is located in an inner area defined by a tubular in the wellbore.

9. An opto-acoustic subsystem, comprising:

an optical transmitter positioned at a surface of a wellbore; and an actuator device positioned in the wellbore and responsive to a modulated electrical signal generated from a modulated optical signal received from the optical transmitter by outputting a modulated acoustical signal into an environment of the wellbore.

10. The opto-acoustic subsystem of claim 9, further comprising an optical fiber coupling the optical transmitter and the actuator device.

11. The opto-acoustic subsystem of claim 9, wherein the actuator device includes a photodiode and a piezoelectric actuator.

12. The opto-acoustic subsystem of claim 11, wherein the actuator device further comprises a blocking diode between the photodiode and the piezoelectric actuator.

13. The opto-acoustic subsystem of claim 12, further comprising a current limiting resistor between the photodiode and the piezoelectric actuator.

14. The opto-acoustic subsystem of claim 9, wherein the optical transmitter includes:

a laser;

a power source for supplying power to the laser;

a signal source; and a modulator for generating the modulated optical signal using light from the laser and a signal from the signal source.

15. The opto-acoustic subsystem of claim 9, wherein the optical transmitter includes:

a signal source;

a laser; and a power source for supplying modulated power to the laser for modulating a signal from the signal source to produce the modulated optical signal.

16. The opto-acoustic subsystem of claim 9, further comprising:

a line extending into the wellbore and coupled to a receiver that is responsive to a detected modulated acoustical signal from a sensor on the line by determining a parameter of the environment of the wellbore.

17. An actuator device, comprising:

a photodiode communicatively coupled to an optical transmitter at a surface of a wellbore by an optical fiber; and a piezoelectric actuator that is responsive to a modulated electrical signal generated by the photodiode from a modulated optical signal received from the optical transmitter by outputting a modulated acoustical signal into an environment of the wellbore.

18. The actuator device of claim 17, wherein the modulated acoustical signal corresponds in frequency to the modulated optical signal.

19. The actuator device of claim 17, further comprising a blocking diode between the photodiode and the piezoelectric actuator.

20. The actuator device of claim 17, further comprising a current limiting resistor between the photodiode and the piezoelectric actuator.

* * * * *